US005566911A

United States Patent [19]

Hoshino

[11] Patent Number: 5,566,911

[45] Date of Patent: Oct. 22, 1996

[54] STAND FOR DRUM AND CYMBAL

[75] Inventor: Yoshiki Hoshino, Aichi-Ken, Japan

[73] Assignee: Hoshino Gakki Co., Ltd., Japan

[21] Appl. No.: 346,899

[22] Filed: Nov. 30, 1994

[30] Foreign Application Priority Data

May 16, 1994 [JP] Japan ..... 6-006628 U

[51] Int. Cl.[6] ..... A47G 29/00

[52] U.S. Cl. ..... 248/124.1; 248/288.51; 248/181.1; 248/316.4

[58] Field of Search ..... 248/121, 124, 248/171, 125, 288.3, 181, 481, 316.4, 229.1, 229.2, 541; 84/421, 411 R

[56] References Cited

U.S. PATENT DOCUMENTS 2,642,250 6/1953 Kasniwich ..... 248/229.1
4,185,808 1/1980 Donohoe et al. ..... 248/295.1
4,453,446 6/1984 Hoshino ..... 84/421
4,606,525 8/1986 Lombardi ..... 84/421
4,747,569 5/1988 Hoshino ..... 84/421
4,796,508 1/1989 Hoshino ..... 84/421

*Primary Examiner*—Karen J. Chotkowski
*Assistant Examiner*—Gwendolyn Wrenn
*Attorney, Agent, or Firm*—Ostrolenk, Faber, Gerb & Soffen, LLP

[57] ABSTRACT

A stand for both a tom tom drum and a cymbal having a lower pipe supported by legs, an intermediate pipe inserted into and protruding above the lower pipe and an upper pipe inserted into the intermediate pipe and protruding adjustably above the intermediate pipe with a cymbal holder on the upper pipe. A tom holder fixed at the intermediate pipe. The tom tom is supported on a support rod having a ball at its end which is received in a rod holder which grasps the ball. The rod holder has a hole in it for receiving the intermediate and upper pipes.

8 Claims, 10 Drawing Sheets

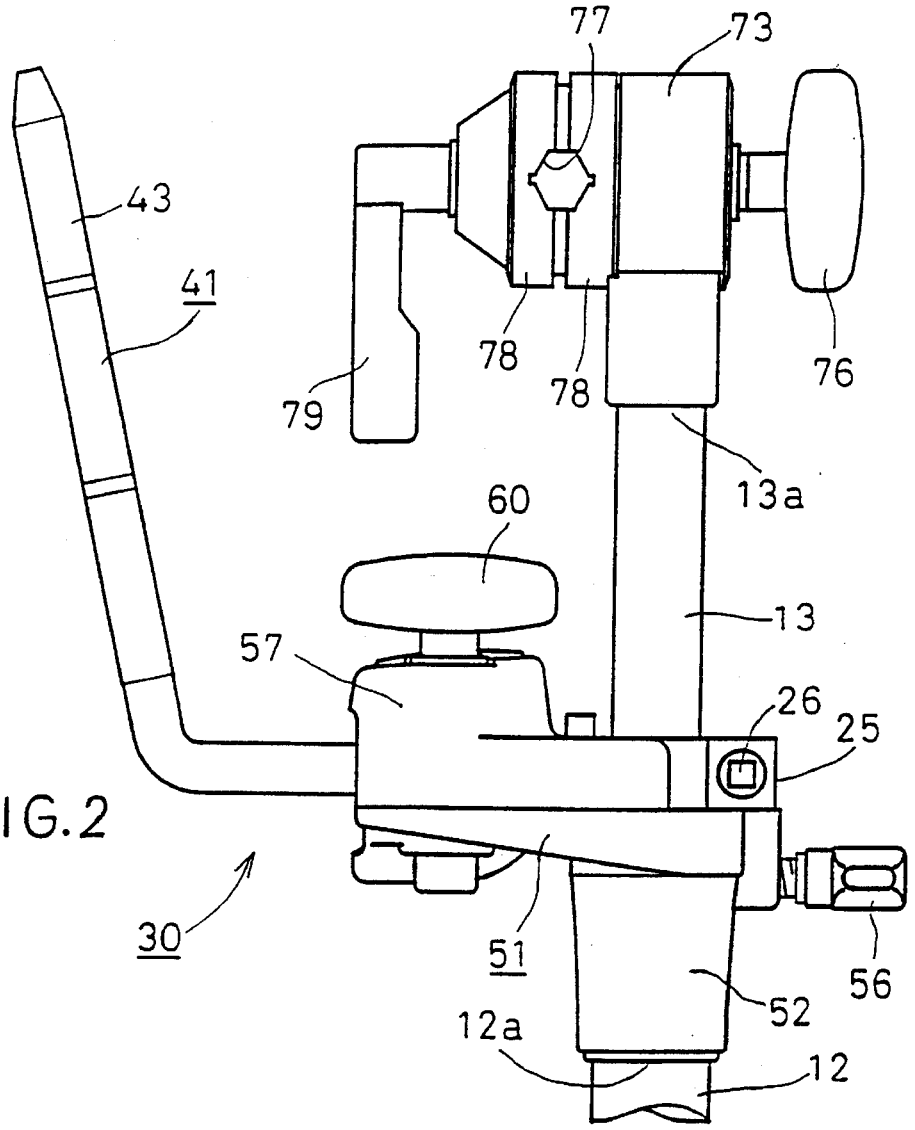
FIG.2
FIG.3
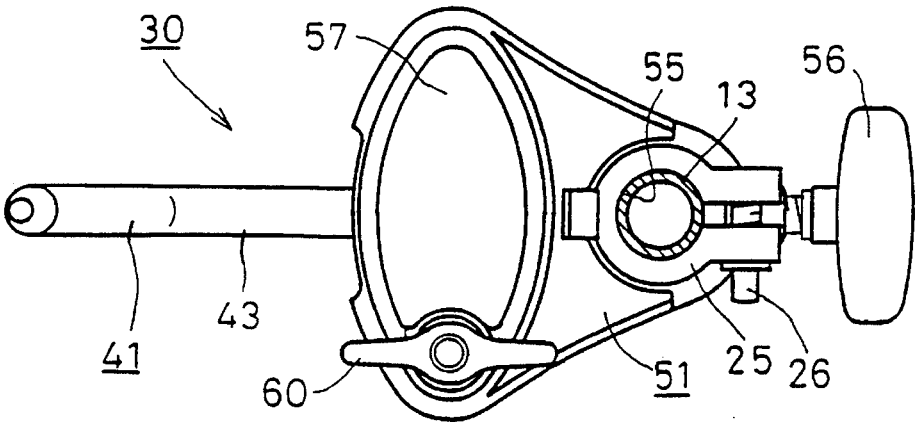

STAND FOR DRUM AND CYMBAL

BACKGROUND OF THE INVENTION

This invention relates to a stand for a drum, particularly a tom tom, and a cymbal.

A medium size drum, usually called a tom tom, is generally held by a tom holder that is installed at the top of the center of a bass drum in a drum set.

A bass drum has low rigidity and includes a trunk or body which is formed like a thin sheet. The installation of a tom tom on the bass drum may strain the trunk of the bass drum due to the weight of either the tom tom or the tom holder. This would lower the quality of the sound or might even crack the trunk of the bass drum in some cases.

Because of this, either a stand which is exclusively for the tom tom is provided or the tom holder is installed on a cymbal stand through an attachment. In the former case, however, a stand has to be prepared anew, causing higher cost. Furthermore, since it reduces the space for the performance, it would be inconvenient for performing in a narrow place.

In the latter case, an attachment on the cymbal stand for the installation of a tom holder becomes necessary, which increases the number of the parts and thereby increases the manufacturing cost. Since it becomes necessary to firmly fix the attachment in such a way as to withstand the weight of the tom tom and the tom holder, there is a danger that the piping of the cymbal stand may be damaged or depressed. In addition, the outside appearance of the resulting structure has not been satisfactory.

SUMMARY OF THE INVENTION

It is an object of the invention to provide a holder for the tom tom and the cymbal which has a satisfactory outside appearance and is capable of firmly holding the tom tom and which can be produced at low cost.

A further object is to provide a stand which can be used both for the tom tom and for the cymbal, can be prepared at low cost, has a satisfactory appearance and is capable of securely holding the tom tom.

The stand comprises a lower pipe. At the bottom of that lower pipe legs are installed. An intermediate pipe is inserted into the top of the lower pipe, and the amount of the protrusion of the intermediate pipe from the top of the lower pipe is made variable. A tom holder is fixed to the top, outer peripheral surface of the intermediate pipe. An upper pipe is inserted into the top of the intermediate pipe, and the amount of its protrusion from the top of the intermediate pipe is variable. A cymbal holder is disposed on the upper pipe.

Other objects and features of the invention are explained with reference to the attached drawings.

BRIEF DESCRIPTION OF THE DRAWINGS

FIG. 2 is a front view of the tom holder and cymbal holder of the stand;

FIG. 3 is a plan view of the tom holder part;

DETAILED DESCRIPTION OF THE PREFERRED EMBODIMENTS

Figure 1:
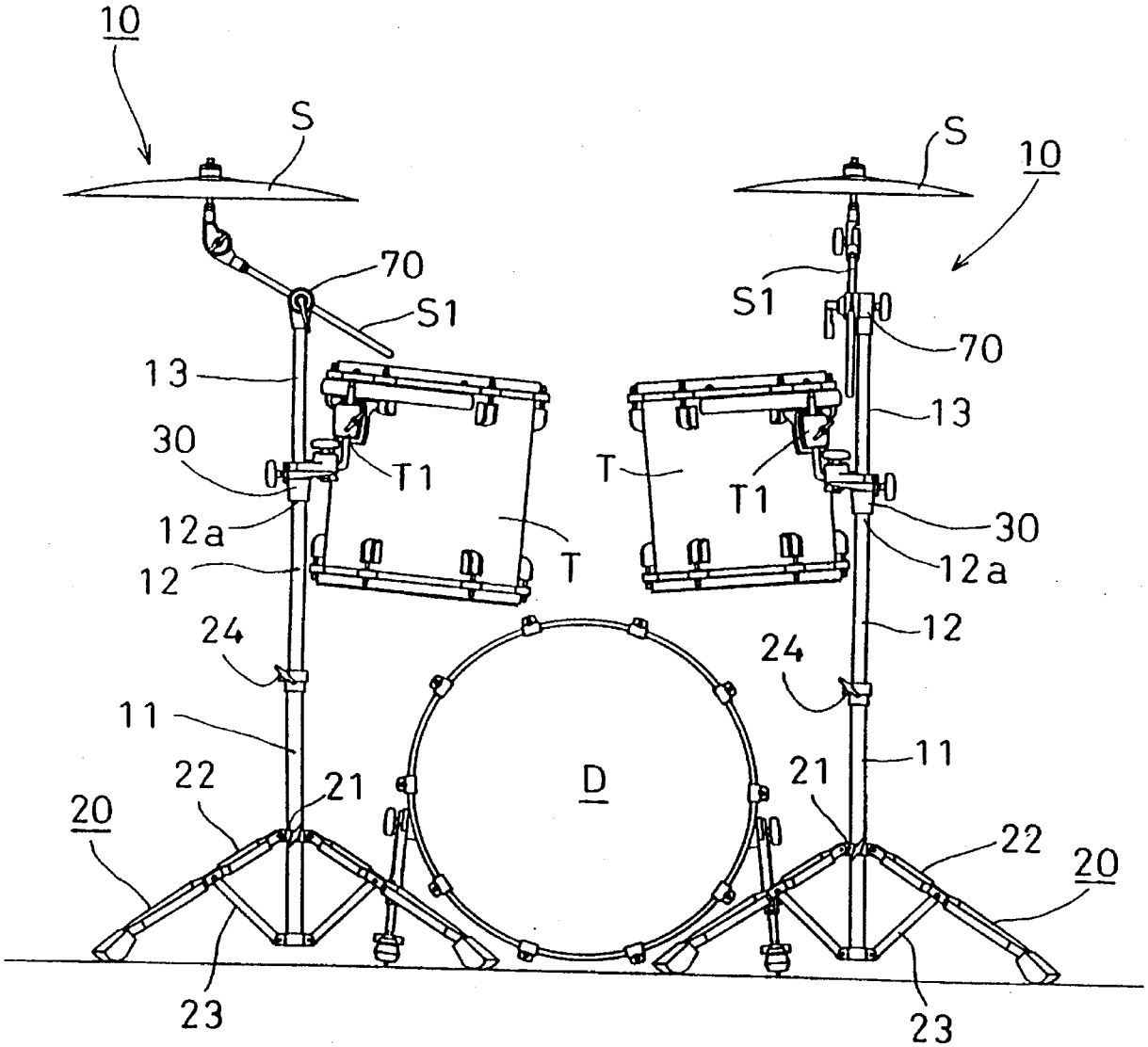
FIG. 1 is a front view of a drum set incorporating a stand for the tom tom and the cymbal according to the invention.
Figure 4:
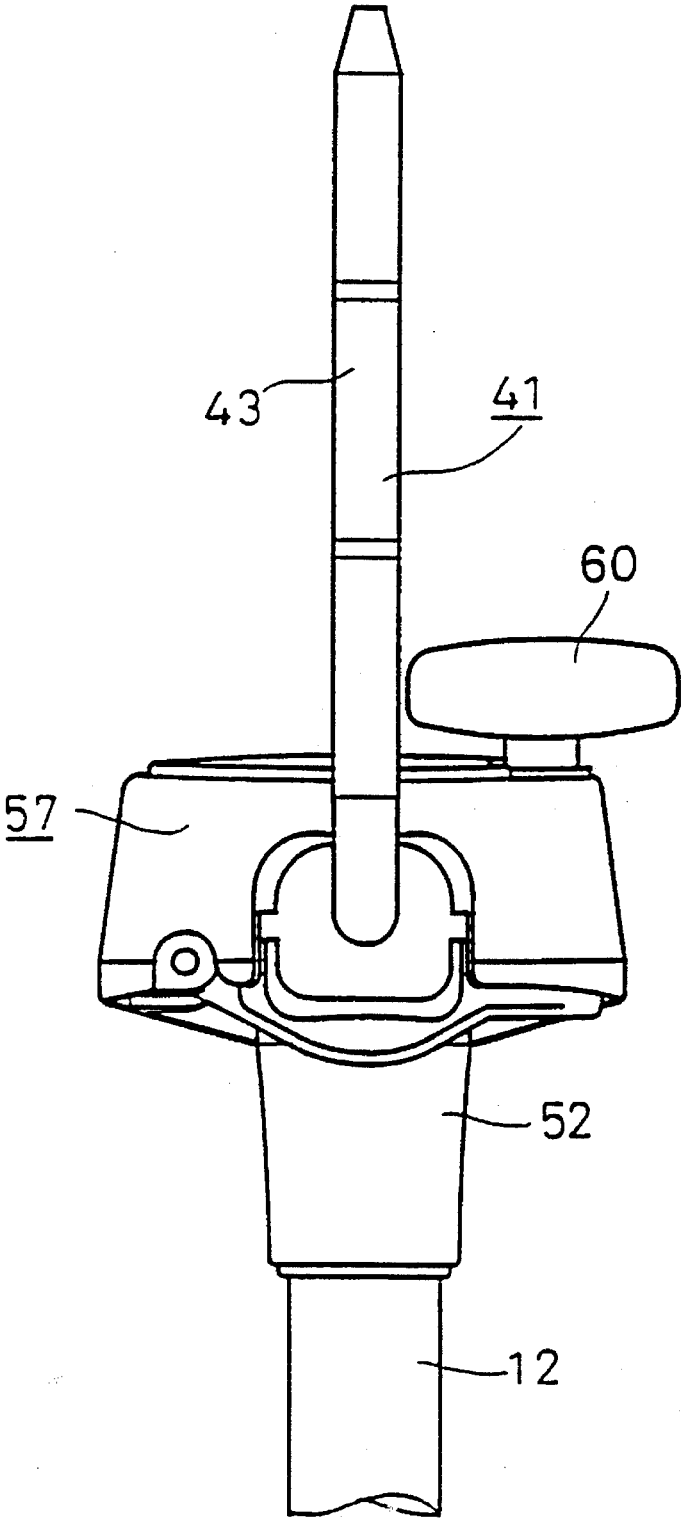
FIG. 4 is left side view of that part.

As is shown in FIG. 1, the stand for the tom tom and the cymbal firmly holds both the tom tom and the cymbal in an economical space arrangement. The stand is arranged in the neighborhood of a drum D such as a bass drum.

The stand 10 comprises a lower vertically oriented pipe 11, an intermediate pipe 12, and an upper pipe 13, along with a tom holder 30 and a cymbal holder 70.

A leg part 20 is installed on the lower pipe 11. The leg part 20 comprises an annular body 21 into which the outer periphery of the lower pipe 11 is inserted such that the body may freely slide up and down, three radial legs 22 having top ends secured to the annular body 21 so as to freely open or close, and an arm member 23 whose lower end is secured freely rotatably to the bottom of the lower pipe 11 and whose upper end is freely rotatably secured to the respective leg 22.

The leg part 20 opens or closes the legs 22 as the annular body 21 slides freely up and down. The opened or closed leg position is fixed by tightening the screw which has been provided on the annular body 21, which secures the annular body 21 at a suitable location along the lower pipe 11.

The intermediate pipe 12 is inserted into the top of the lower pipe 11, and the length of its protrusion from the top of the lower pipe 11 is made variable. The intermediate pipe 12 has the purpose of installing the tom holder 30 and the upper pipe 13 and adjusting the height of the tom holder 30.

A screw 24 fixes the intermediate pipe 12 at the desired upraised or lowered position. It is inserted through the pipe wall at the top of the lower pipe 11. As this screw 24 is loosened, the intermediate pipe 12 is moved up and down. When it is tightened, the position of the intermediate pipe 12 is fixed.

The tom holder 30 has the purpose of holding the tom tom T. It is fixed on the upper outer peripheral surface **12*a* of the intermediate pipe 12. As is shown in FIGS. 2 through 7, the tom holder comprises a tom tom support rod 41 on which the tom tom is installed and a main holder body 51 which fixes the tom tom support rod 41 to the intermediate pipe 12**.

Figure 6:
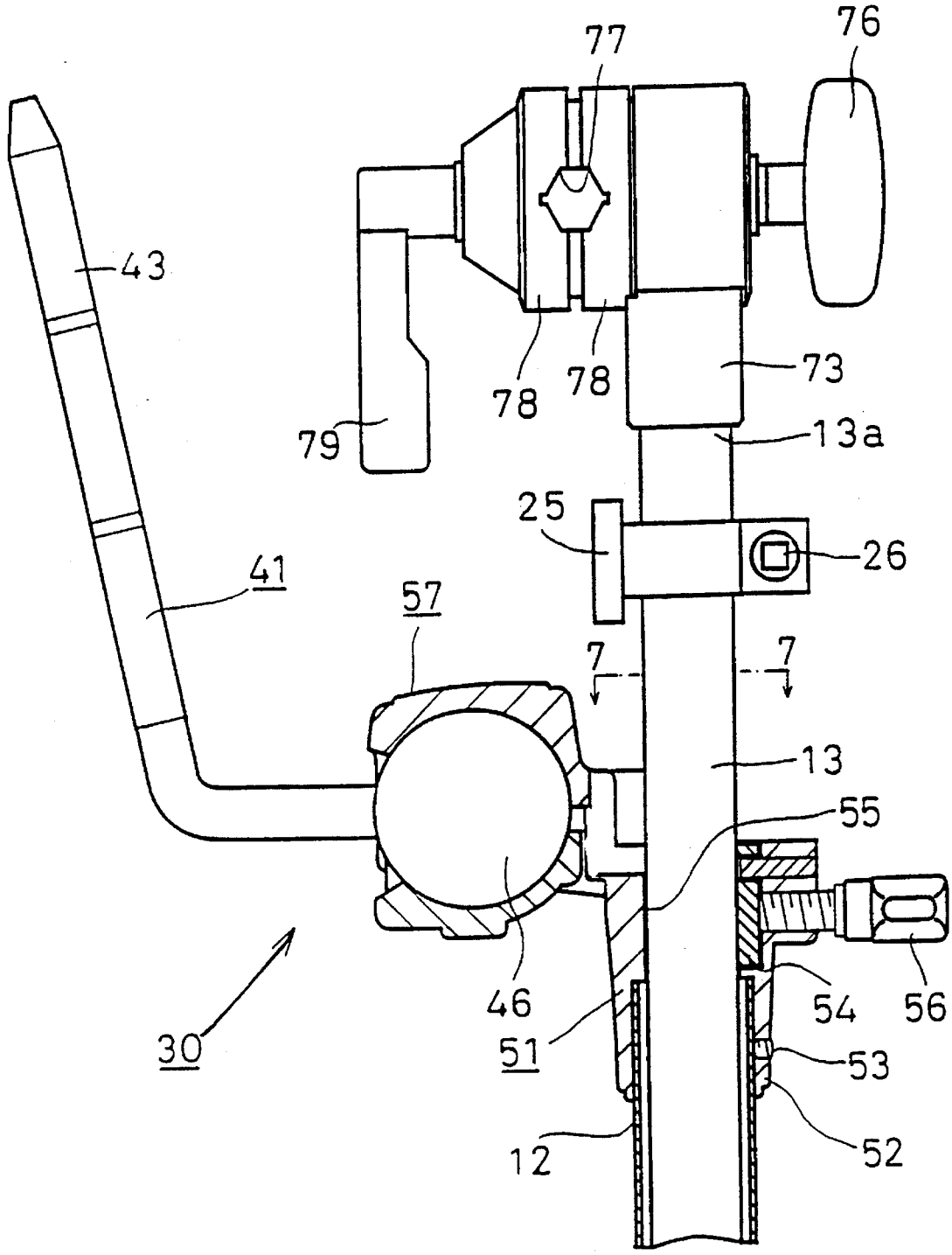
FIG. 6 is a cross section showing the essential part thereof with its memory lock released.
Figure 7:
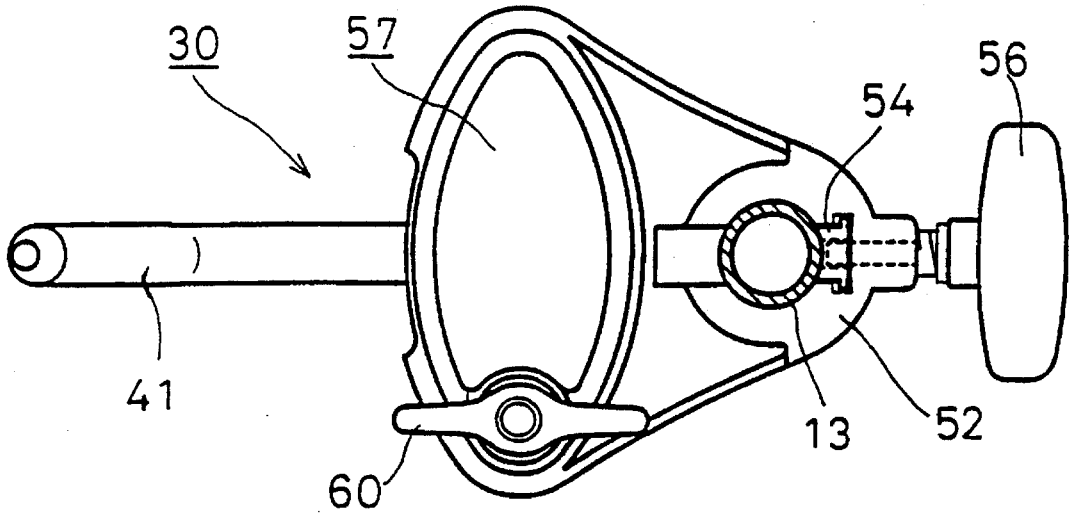
FIG. 7 is a cross section cut along line 7–7 of FIG. 6.
Figure 8:
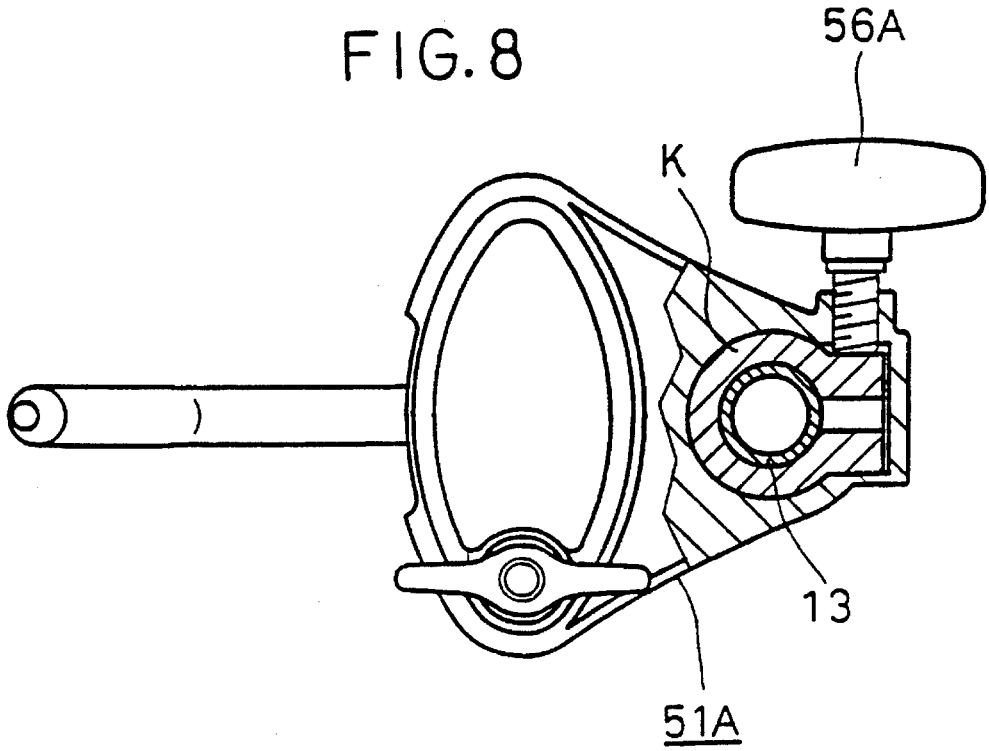
FIG. 8 is plane figure showing a partial cross section of another example of a tom holder.

As is shown in FIG. 6, the tom tom support rod 41 is a bar-shaped body 43 which is approximately L-shaped. A ball shaped part 46 is provided at its base. An installation bracket T1 (FIG. 1) for the tom tom T is installed on the top of the rod 41 for the installation of the tom tom T.

The main tom holder body 51 is installed on the upper outside periphery of the intermediate pipe 12 and is fixed to the intermediate pipe 12 by pressure and a screw. The body 51 comprises a tubular body 52 having an intermediate pipe insertion region of greater diameter and upper pipe insertion hole 55 of lesser diameter . The bottom of the body 51 includes a hole for insertion therein of the intermediate pipe 12 up to the top of the greater diameter hole in the body 51. Its top serves as a hole for the insertion of the upper pipe and a rod holding part 57 which protrudes to the side of the tubular body 52. A screw 53 fixes the main holder body 51 to the intermediate pipe 12.

A tightening bolt 56 fixes the top and bottom positions of the upper pipe 13 at the top of the tubular body 52. The tightening bolt 56 has an inner tip that presses on the outer peripheral surface of the upper pipe 13 through a pipe holder 54. This fixes the top and bottom positions of the upper pipe 13. Obviously, other means may be used for fixing the position of the upper pipe 13. For example, a tightening metal tool K that envelopes the outer peripheral surface of the upper pipe 13 may be provided inside the main holder body 51A and the tightening metal tool K may be tightened to the outer peripheral surface of the upper pipe 13 by a tightening bolt 56A, thereby fixing the position of the upper pipe 13.

Figure 5:
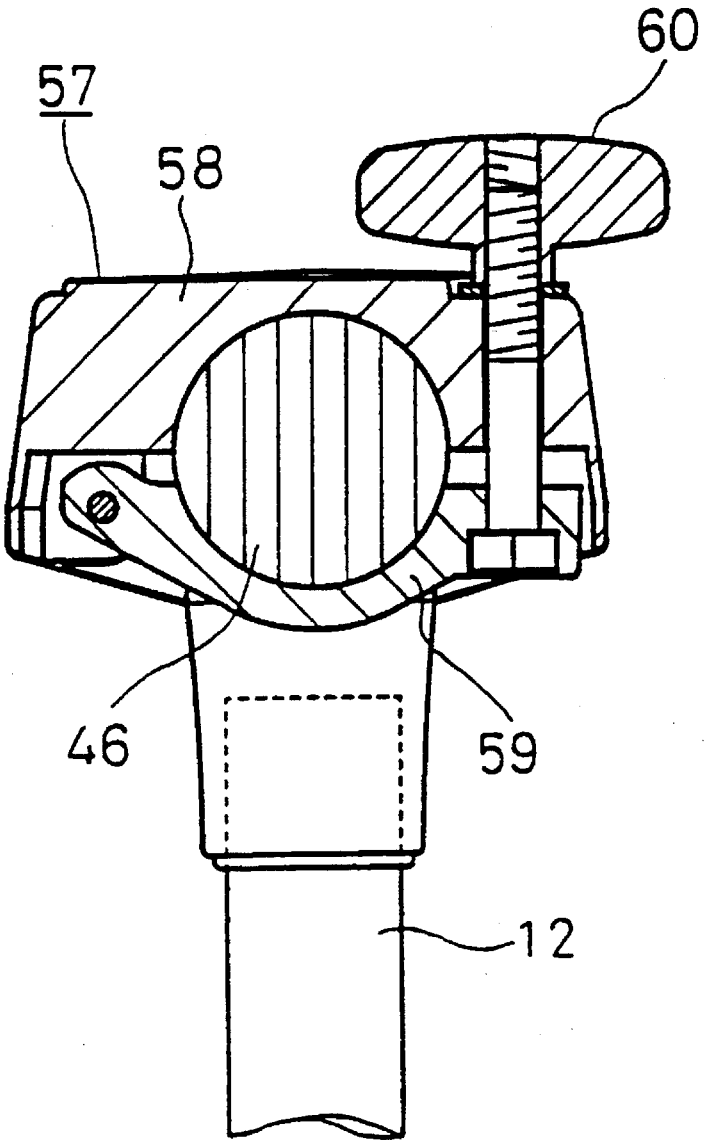
FIG. 5 is a longitudinal section of that part.

The rod holder 57 maintains the orientation of the tom tom support rod 41 by holding the ball 46 at the bottom of the rod. In FIG. 5, the rod holder comprises a ball receptacle 58 which rotatably holds the ball 46 of the tom tom support rod 41, a ball pressing part 59 which is fixed to the ball receptacle 58 so as to be freely opened or closed and which compresses the ball 46 and a tightening nut 60 which tightens the ball pressing part 59 toward the ball receptacle part 58.

The rod holder 57 holds and fixes the ball 46 of the aforesaid tom tom support rod between the ball receptacle 58 and the ball pressing part 59 upon tightening of the tightening nut 60.

The upper pipe 13 is inserted into the intermediate pipe 12 and protrudes from the top of the intermediate pipe 12, over a length that can be made variable. The upper pipe 13 holds the cymbal as the cymbal holder 70 is installed. At the same time, this makes the height of the cymbal adjustable.

The upper pipe 13 includes a memory lock 25 for easily adjusting the height of the protrusion of the upper pipe from the intermediate pipe 12 to a preset level. The memory lock 25 comprises a convex member which is installed over the outer periphery of the upper pipe 13 so as to freely slide up and down. Its top and bottom positions can be fixed using a screw 26, and it is fixed at the desired top and bottom positions of the upper pipe 13 by the screw 26.

When the bottom of the upper pipe 13 is inserted into the top of the intermediate pipe 12 a prescribed distance, the fixed memory lock 25 hits the upper surface of the main holder body 51, thereby preventing the upper pipe 13 from being further inserted. This enables the amount of the protrusion of the upper pipe 13 to be easily adjusted to the same protruding position as during previous use for all reuse of this stand 10.

The cymbal holder 70 holds the cymbal S at the top of the stand 10. It is positioned on the upper pipe 13.

The cymbal holder 70 includes a tubular vertical body 73 having an upper pipe insertion hole and includes the clampable cymbal rod holding member 78. As the upper pipe 13 is pressed into the upper pipe insertion hole in the tubular body 73, it is fixed to the top outer peripheral surface 13*a* of the upper pipe.

The cymbal holding member 78 has a concave 77 for receiving a support rod S1 for holding the cymbal S. The support rod S1 of the cymbal may be held and fixed by the tightening bolt 79 where it is freely rotatably fixed to the side of the tubular body by the tightening bolt 76.

Figure 9:
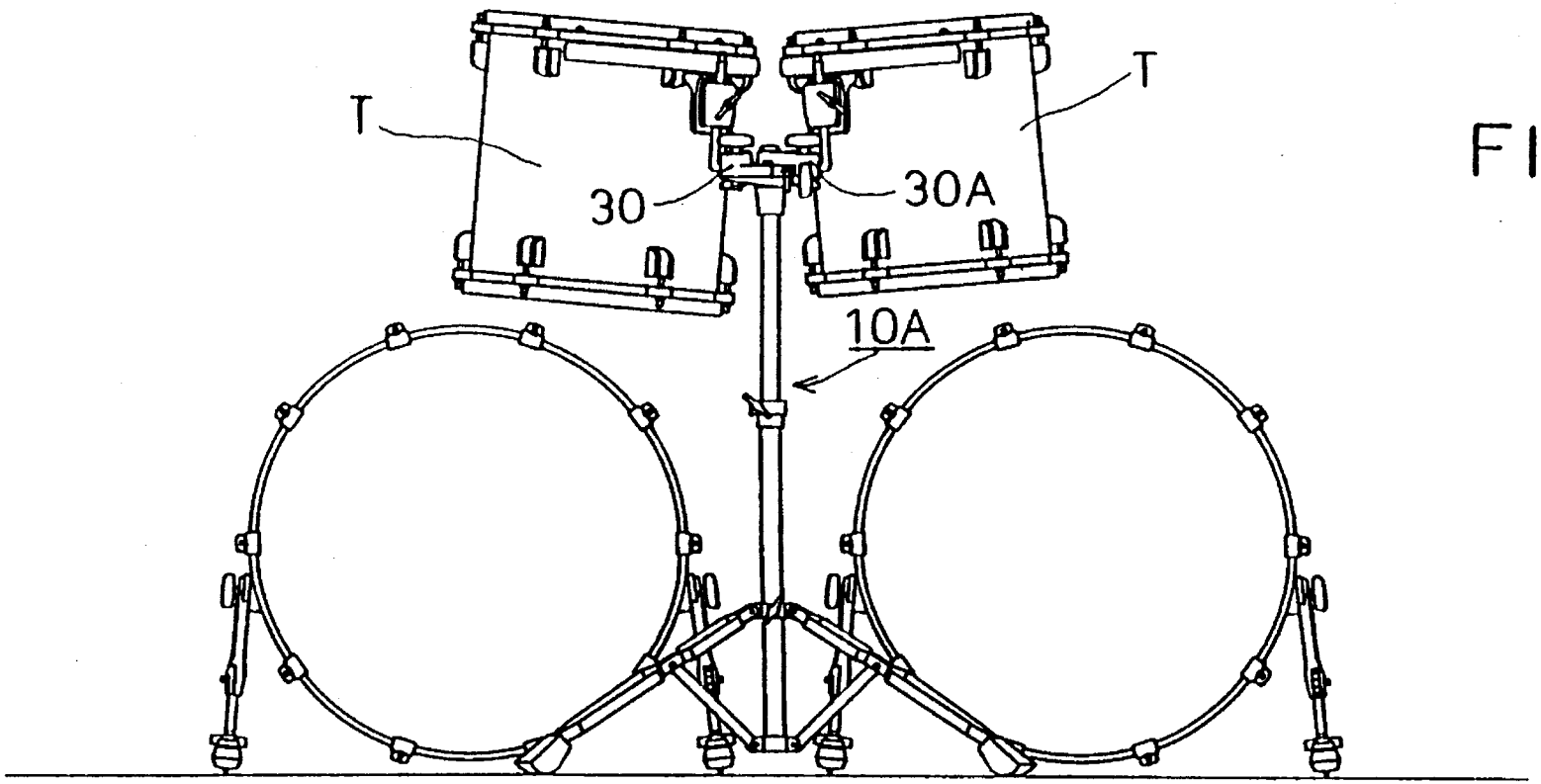
FIG. 9 is a front view of another example of a drum set incorporating the stand for the tom tom and the cymbal.
Figure 10:
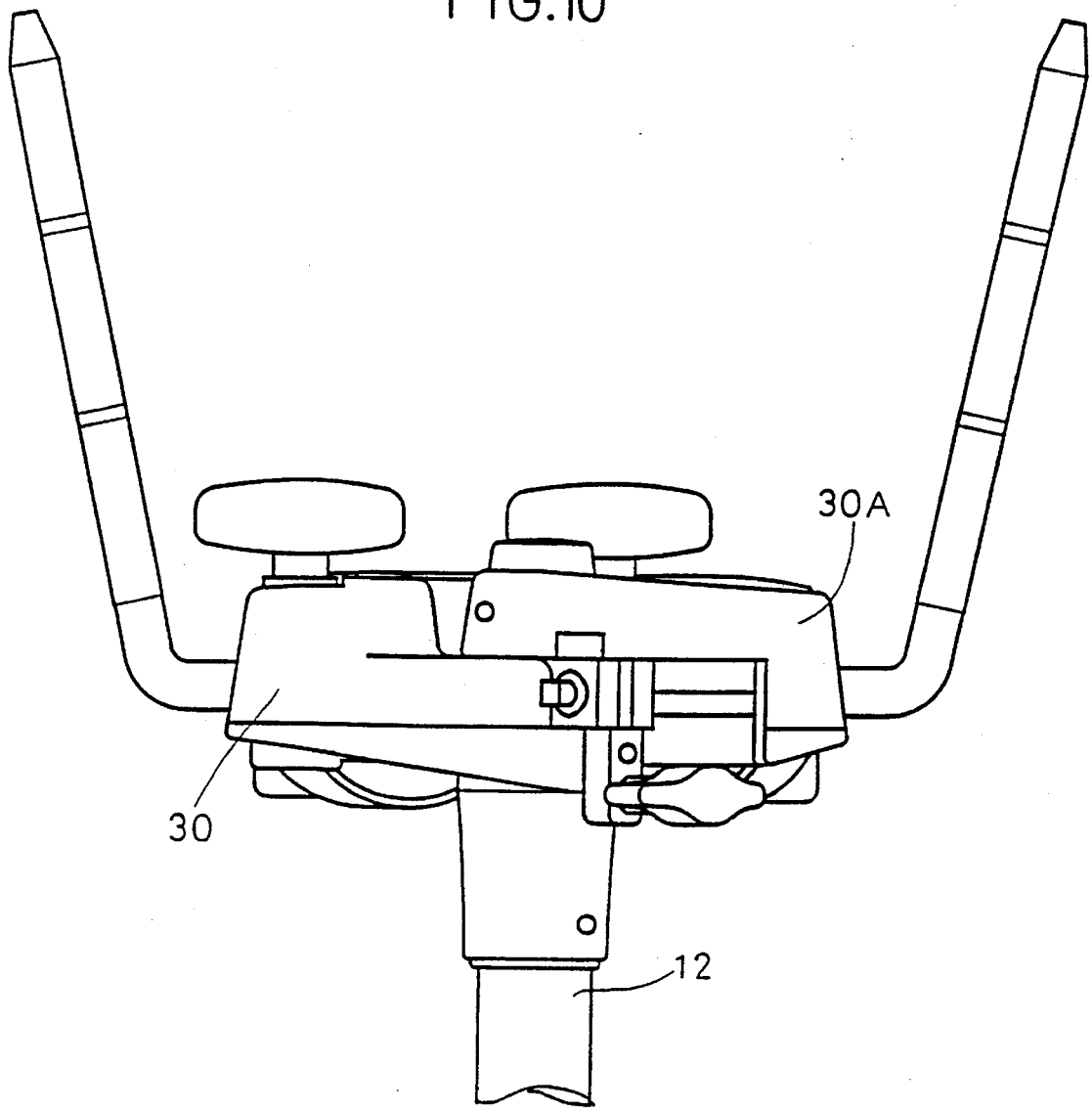
FIG. 10 is a front view of the essential part of the stand for the tom tom and the cymbal.
Figure 11:
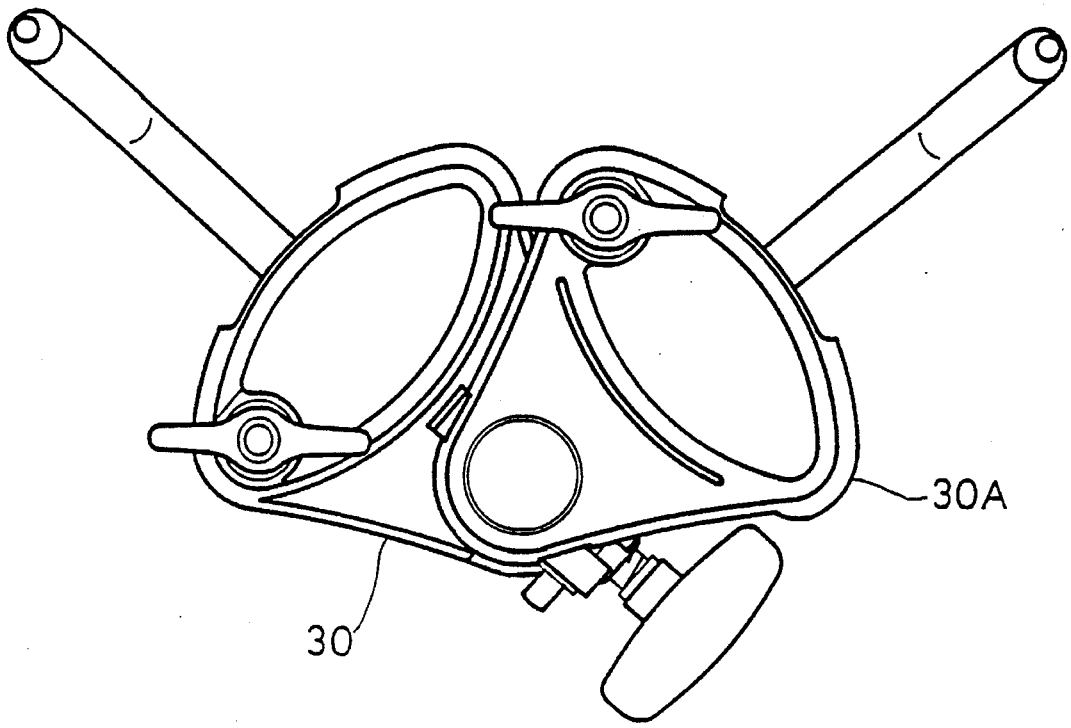
FIG. 11 is a plan view thereof.

For this stand for the cymbal and the tom tom shown in FIG. 1, one tom holder 30 and one cymbal holder 70 have been provided. For the stand 10A shown in FIG. 9, however, the tom holder 30A may be provided on the upper pipe in place of the cymbal holder 70. It is then desirable for the tom holder 30A to be shifted or tilted by a certain angle from the tom holder 30, as is shown in FIGS. 10 and 11. This avoids any possible contact between the two tom toms T. The tom holders 30 and 30A are constructed the same.

Figure 12:
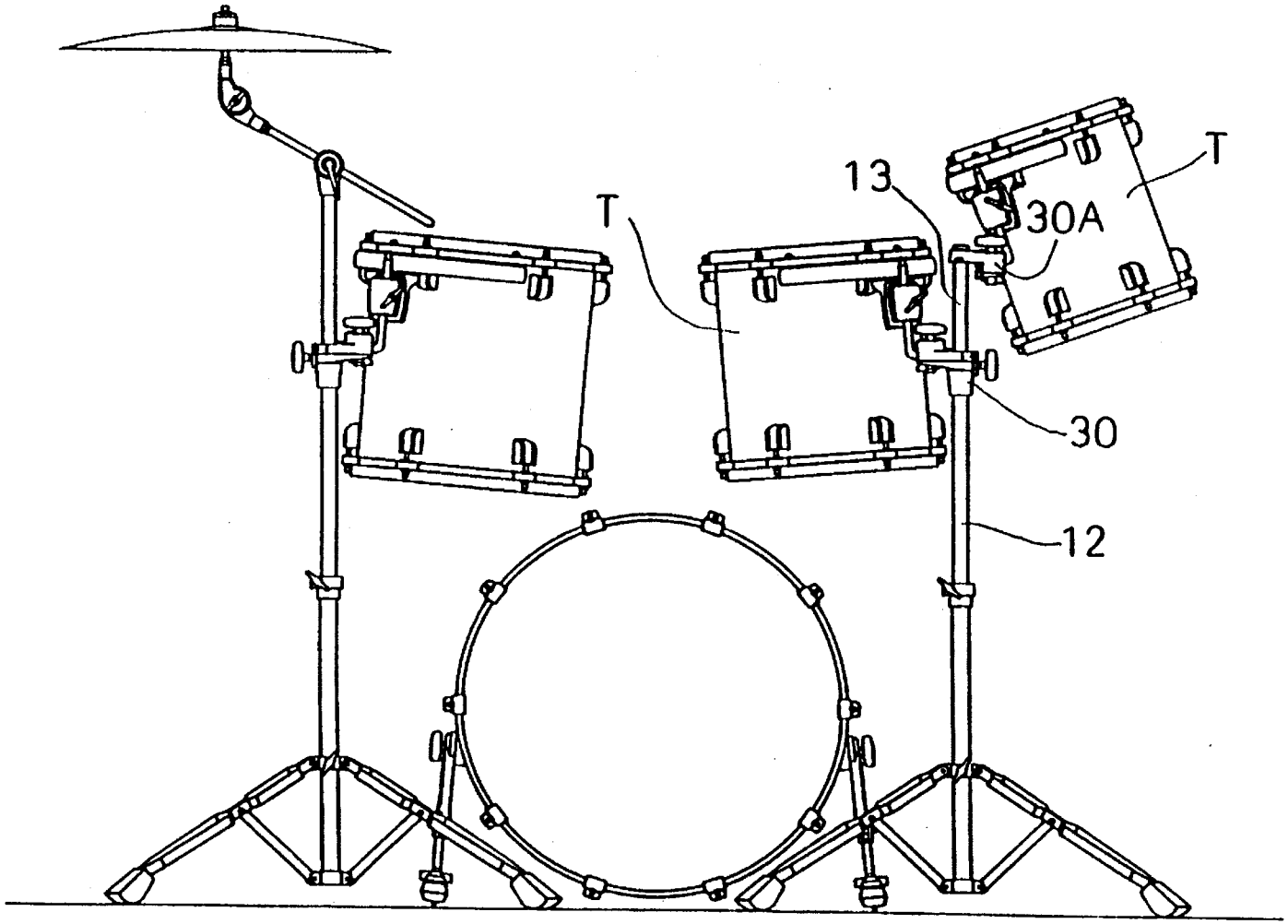
FIG. 12 is a front view of still another example of the drum set incorporating the stand for the tom tom and cymbal.

Moreover, the upper pipe 13 may protrude from the intermediate pipe 12, as shown in FIG. 12, thereby providing a height difference between the tom holders 30 and 30A.

The stand for the tom tom and the cymbal directly installs the tom holder on the intermediate pipe without using an attachment. As a result, the number of parts used can be smaller, making the stand more economical. At the same time, there is no danger of the pipe being damaged or depressed due to the weight of the tom tom or the tom holder.

Because both a tom tom and a cymbal can be held, the total number of the stands can be reduced, thereby offering the advantage of the stand not occupying too much space.

As no attachment is used in the installation of the tom tom, moreover, the outside appearance of the stand can be satisfactory.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claim is:

1. A stand for a tom tom drum and a cymbal, comprising:

a lower pipe with a leg part thereon for supporting the lower pipe;

an intermediate pipe inserted into the lower pipe and protruding an adjustable first distance above the lower pipe, the intermediate pipe having a top end;

a tom holder fixed to the top end of the intermediate pipe, an upper pipe inserted into the intermediate pipe and protruding an adjustable second distance above the intermediate pipe, the upper pipe being adjustable in height relative to the intermediate pipe and with reference to the tom holder; and a cymbal holder on the upper pipe;

securing means on the tom holder for being tightened on the upper pipe where the upper pipe passes the tom holder for securing the adjusted height of the upper pipe protruding above the intermediate pipe.

2. The stand of claim 1, wherein the intermediate pipe has an outer peripheral surface, the tom holder being fixed to the outer peripheral surface.

3. The stand of claim 1, wherein the tom holder comprises a tom tom support rod and holding means for holding the rod at a selected orientation.

4. The stand of claim 3, wherein the support rod has a base with a ball part at the base, and the holding means includes a ball holding part for grasping the ball for holding the rod orientation.

5. The stand of claim 4, wherein the holding means comprises a tubular body including a hole therein for insertion therein of the intermediate pipe and the upper pipe.

6. The stand of claim 1, wherein the tom holder comprises a tubular body including a hole therethrough for receiving the top end of the intermediate pipe and for receiving the parts of the upper pipe that are inserted into and that protrude above the intermediate pipe.

7. The stand of claim 6, wherein the hole in the tom holder is shaped for causing the tom holder to rest on the top end of the intermediate pipe and for enabling the upper pipe to be moved and adjusted with reference to both the tom holder and the intermediate pipe without moving the tom holder off the top of the intermediate pipe.

8. A stand for a tom tom drum and a cymbal, comprising:

a lower pipe with a leg part thereon for supporting the lower pipe;

an intermediate pipe installed at the lower pipe and protruding an adjustable first distance above the lower pipe the intermediate pipe having a top end;

a tom holder fixed to the top end of the intermediate pipe, an upper pipe installed at the intermediate pipe and protruding an adjustable second distance above the intermediate pipe, the upper pipe being adjustable in height relative to the intermediate pipe and with reference to the top holder; and a cymbal holder on the upper pipe;

securing means on the tom holder for being tightened on the upper pipe where the upper pipe passes the tom holder for securing the adjusted height of the upper pipe protruding above the intermediate pipe.

* * * * *